US008752581B2

(12) United States Patent
Haslberger

(10) Patent No.: US 8,752,581 B2
(45) Date of Patent: Jun. 17, 2014

(54) HYDRAULIC TANK FOR AN INDUSTRIAL TRUCK

(75) Inventor: Johannes Haslberger, St. Wolfgang (DE)

(73) Assignee: Jungheinrich Aktiengesellschaft, Hamburg (DE)

( * ) Notice: Subject to any disclaimer, the term of this patent is extended or adjusted under 35 U.S.C. 154(b) by 241 days.

(21) Appl. No.: 13/316,844

(22) Filed: Dec. 12, 2011

(65) Prior Publication Data

US 2012/0145267 A1 Jun. 14, 2012

(30) Foreign Application Priority Data

Dec. 13, 2010 (DE) ..... 10 2010 062 953
Feb. 23, 2011 (DE) ..... 10 2011 004 596

(51) Int. Cl.
*B60P 3/22* (2006.01)

(52) U.S. Cl.
USPC ..... 137/592; 137/899; 137/574; 137/576; 137/262

(58) Field of Classification Search
USPC ..... 137/588, 576, 574, 590, 592, 899, 262, 137/391, 587, 426; 220/734; 280/830
See application file for complete search history.

(56) References Cited

U.S. PATENT DOCUMENTS

| | | | | | |
|---|---|---|---|---|---|
| 4,414,810 | A * | 11/1983 | Reinartz et al. | 60/535 |
| 5,141,179 | A * | 8/1992 | Gautier | 244/135 R |
| 5,564,749 | A * | 10/1996 | Branham | 280/830 |
| 6,585,128 | B2 * | 7/2003 | Clevenger et al. | 220/303 |
| 6,619,317 | B2 * | 9/2003 | Evanovich et al. | 137/549 |
| 6,978,802 | B2 * | 12/2005 | Hagano et al. | 137/574 |
| 2009/0283159 | A1 * | 11/2009 | Schaefer, Jr. | 137/587 |

FOREIGN PATENT DOCUMENTS

| | | | |
|---|---|---|---|
| DE | 19612582 | A1 | 10/1997 |
| DE | 103 12 432 | A1 | 4/2003 |
| DE | 102004030560 | A1 | 1/2006 |
| DE | 102005035845 | A1 | 2/2007 |
| DE | 10013079 | A1 | 9/2011 |
| JP | 06191297 | A | 12/1994 |

* cited by examiner

*Primary Examiner* — John K Fristoe, Jr.
*Assistant Examiner* — Angelisa Hicks
(74) *Attorney, Agent, or Firm* — Rothwell, Figg, Ernst & Manbeck, P.C.

(57) ABSTRACT

A hydraulic tank for an industrial truck having a tank lower part with a base and a side wall and produced in one piece, a tank cover which is connected to an upper edge of the side wall, is produced in one piece and defines at least one hydraulic medium receiving chamber together with the base and the side wall, at least one hydraulic medium intake pipe extending from a hydraulic medium suction connector of the tank cover, and at least one hydraulic medium return pipe extending from a hydraulic medium return connector of the tank cover, wherein the hydraulic medium intake pipe and the hydraulic medium return pipe, together with the tank cover, form a tank upper part which is assembled as a modular unit with the tank lower part to form the hydraulic tank.

19 Claims, 6 Drawing Sheets

HYDRAULIC TANK FOR AN INDUSTRIAL TRUCK

CROSS REFERENCE TO RELATED APPLICATION

This Application claims the benefit of German Application Nos. 102010 062 953.7 filed on Dec. 13, 2010 and 10 2011 004 596.1 filed on Feb. 23, 2011, the disclosures of which are incorporated herein in their entirety by reference.

The invention relates in general to a hydraulic tank for an industrial truck.

In particular, the invention starts from a hydraulic tank for an industrial truck, comprising:

- a tank lower part comprising a base and a side wall and produced in one piece;
- a tank cover which is connected to an upper edge of the side wall, is produced in one piece and defines at least one hydraulic medium receiving chamber together with the base and the side wall;
- at least one hydraulic medium intake pipe extending from a hydraulic medium suction connector of the tank cover, preferably into a lower region of the hydraulic medium receiving chamber; and
- at least one hydraulic medium return pipe extending from a hydraulic medium return connector of the tank cover, preferably into a lower region of the hydraulic medium receiving chamber.

To raise and lower loads, industrial trucks comprise a hydraulic apparatus having an associated hydraulic tank. The hydraulic apparatus typically consists of a drive motor, usually an electric motor, and a pump operated by the drive motor, which sucks the hydraulic medium (hydraulic oil) from the hydraulic tank via a suction connector of the hydraulic tank. For example, in order to raise loads a single-acting lifting cylinder is actuated via the hydraulic apparatus, wherein a check valve for example may be provided in the hydraulic apparatus to hold the load on the hydraulic cylinder. If a load is lowered using the industrial truck, the hydraulic medium flows back into the hydraulic tank via a return line and a return connector of the hydraulic tank. The hydraulic medium (hydraulic oil) is typically returned via a return filter unit. The hydraulic apparatus may also supply other functional components of the industrial truck with pressurised hydraulic medium, for example a steering device.

An object of the invention is to provide a hydraulic tank of the aforementioned type which can be produced in a cost-effective manner.

A further object of the invention is to provide a hydraulic tank of the aforementioned type which can be installed in an industrial truck and brought into an operation-ready state without great installation outlay.

To achieve at least one of these objects, the invention proposes that the hydraulic medium intake pipe and the hydraulic medium return pipe form a tank upper part together with the tank cover, which tank upper part is assembled as a modular unit with the tank lower part to form the hydraulic tank.

In accordance with the invention, the tank upper part and therefore the hydraulic tank comprises the hydraulic medium intake pipe and the hydraulic medium return pipe as integral components, and therefore these do not have to be installed retrospectively. The hydraulic tank and also the hydraulic medium intake pipe and the hydraulic medium return pipe together with the associated hydraulic medium suction connector and hydraulic medium return connector are thus provided in an installation-ready state. This hydraulic tank can be manufactured in a cost-effective manner, since the assembly process is carried out on the basis of a tank upper part comprising the tank cover, the hydraulic medium intake pipe and the hydraulic medium return pipe, which tank upper part is assembled as a modular unit with the tank lower part to form the hydraulic tank. The tank cover is preferably welded to the upper edge of the side wall, wherein laser welding is considered above all (but not exclusively).

Manufacturing advantages, in particular in terms of the saving of manufacturing costs, are achieved in particular if at least one of the hydraulic medium intake pipe and the hydraulic medium return pipe is produced in one piece with the tank cover, preferably in an injection moulding procedure.

At least one of the hydraulic medium intake pipe and the hydraulic medium return pipe may extend obliquely to a vertical axis of the hydraulic tank. If the hydraulic tank is produced in an injection moulding procedure in which the vertical axis corresponds to the direction of demoulding of the injection moulding die, it is preferable that such a pipe extending obliquely to the vertical axis is not produced in one piece with the tank cover, but is instead produced separately and then joined to the cover, for example welded or adhesively bonded thereto. Such an embodiment is not of interest for a pipe extending obliquely, however. It is therefore generally proposed for at least one of the hydraulic medium intake pipe and the hydraulic medium return pipe, preferably the pipe extending obliquely to the vertical axis, to be welded or adhesively bonded to the cover.

At least one of the hydraulic medium intake pipe and the hydraulic medium return pipe, preferably the hydraulic medium intake pipe, may expediently extend in the direction of the vertical axis of the hydraulic tank. With regard to such a pipe it is above all imagined that this is produced in one piece with the tank cover, preferably in an injection moulding procedure. The vertical axis may then expediently correspond to the direction of demoulding of the injection moulding die.

The hydraulic medium suction connector is preferably produced in one piece with the hydraulic medium intake pipe and/or with the cover. The hydraulic medium return connector is preferably produced in one piece with the hydraulic medium return pipe and/or with the cover.

It is further imagined that the cover is formed with at least one of a) at least one holding formation, produced preferably in one piece with the cover, on a cover outer face for holding the tank in the industrial truck, b) at least one air filter connector which is produced preferably in one piece with the cover and preferably comprises a screw thread for screwing to an air filter, c) at least one engagement formation, produced preferably in one piece with the cover, on a cover inner face for engagement with an intermediate element provided for tank reinforcement and/or as baffle in the hydraulic medium receiving chamber and extending between a front and a rear wall portion of the wall, d) at least one intermediate element, on a cover inner face, which is produced preferably in one piece with the cover, extends between a front and a rear wall portion of the wall, and is provided in the hydraulic medium receiving chamber for tank reinforcement and/or as a baffle, e) at least one holding formation, on a cover outer face, produced preferably in one piece with the cover for holding a hydraulic line or another component associated or to be associated spatially with the hydraulic tank.

The possible aforementioned embodiments c) and d) are not obligatory, but are typically to be considered as alternatives. Owing to the production in one piece with the cover, the installation of separate components which would otherwise be necessary is saved, as a result of which significant cost advantages are provided.

With regard to the tank lower part, it is proposed that a front and a rear wall portion are connected by at least one intermediate element extending therebetween, preferably formed as a partition wall comprising at least one hydraulic medium passage or as an open partition wall, which intermediate element acts as baffle and/or as tank reinforcement. A hydraulic medium baffle (oil baffle) and a tank reinforcement are generally necessary, since the hydraulic tank is arranged in a moving industrial truck which is to be accelerated and decelerated and steered around corners, and therefore the hydraulic medium is subjected to corresponding inertial forces which are to be retained and for which the resultant medium relocations are to be limited. Furthermore, a specific low pressure or overpressure may be produced in the tank during operation of the industrial truck or of the hydraulic apparatus, which pressure could lead to deformations of the tank walls which are counteracted by the proposed tank reinforcement.

In this regard it is considered to be particularly preferred if the intermediate element is produced in one piece, preferably in an injection moulding procedure, with the side wall or in each case is engaged positively, on the front and rear wall portions, with a holding formation, produced in one piece with the side wall preferably in an injection moulding procedure, of the front and rear wall portions. In this regard it is further proposed for both tensile forces and compressive forces to be transferable between the front and rear wall portions by means of the intermediate element or by means of the intermediate element and the positive engagement with the holding formations.

If not only compressive forces, but also tensile forces are transferable between the front and rear wall portions, a deformation of the tank walls as a result of inertial forces acting on the hydraulic medium or owing to overpressures in the tank are counteracted to a sufficient extent.

A plurality of such intermediate elements may expediently be provided, are arranged at a distance from one another in a transverse direction of the tank corresponding to a horizontal primary direction of extension of the tank, and divide said tank into sections which preferably communicate with one another.

The embodiment with one or more intermediate elements in positive engagement with the wall portions is considered to be particularly expedient. For this purpose it is proposed, in terms of development, for the holding formations of the front and rear wall portions to be formed as holding webs which extend on the inner face of the wall in the direction of a vertical axis of the hydraulic tank and which each comprise a holding aperture extending in the direction of the vertical axis, which aperture widens in the transverse direction starting from a slit so as to engage with a holding edge, shaped in a substantially complementary manner, of the intermediate element to form the positive engagement. The positive engagement may be designed in the manner of a dovetail joint. As mentioned, the vertical axis preferably corresponds to the direction of demoulding of the die during production of the tank lower part in an injection moulding procedure.

The intermediate element or the plurality of intermediate elements is/are each inserted via its/their holding edges into the holding aperture in the two associated holding webs in the direction of the vertical axis, preferably until they contact, if desired, a stop offset upwardly from the base.

If the hydraulic tank comprises a pipe extending obliquely to the vertical axis of the hydraulic tank, this pipe may expediently be held or supported by means of an intermediate element connecting the front and rear wall portions. It is specifically proposed for the pipe of the hydraulic medium intake pipe and of the hydraulic medium return pipe extending obliquely to the vertical axis of the hydraulic tank to be held at a lower end portion by an intermediate element connecting the front and rear wall portions, wherein the end portion preferably extends through an aperture in the intermediate element and is preferably welded or adhesively bonded thereto.

The intermediate element may be an intermediate element as discussed above which acts as a baffle and/or as tank reinforcement. However, it may also be an intermediate element which is possibly additional compared to such an intermediate element and which is primarily used for pipe holding. In the latter case also, the positive holding of the intermediate element by holding webs via holding apertures and the design of the intermediate element with holding edges shaped in a substantially complementary manner are provided as being particularly expedient.

With regard to the tank lower part, it is further considered that this is designed with at least one of a) at least one holding formation, produced preferably in one piece with the tank lower part, on an outer face of the wall and/or on an outer face of the base for holding the tank in the industrial truck,
b) at least one hydraulic medium outlet which is produced preferably in one piece with the tank lower part in the base thereof and which preferably comprises a screw thread for closure via a closure element which can be screwed in,
c) at least one holding formation, produced preferably in one piece with the tank lower part, on an inner face of the base for holding a lower end portion of an associated one of the hydraulic medium intake pipe and the hydraulic medium return pipe,
d) at least one further hydraulic medium return connector, produced preferably in one piece with the tank lower part,
e) at least one minimum marking and at least one maximum marking on an outer face of the wall for identifying at least one intended minimum and at least one intended maximum fill level of the hydraulic medium in the hydraulic medium receiving chamber, wherein the markings are preferably produced in one piece with the tank lower part,
f) at least one holding formation, produced preferably in one piece with the tank lower part, on an outer face of the wall for holding a hydraulic line or another component associated or to be associated spatially with the hydraulic tank.

Owing to the production in one piece with the tank lower part, the separate installation of corresponding components produced separately is saved.

At least the tank cover and the tank lower part of the hydraulic tank are preferably produced from a thermoplastic polymer material, preferably a polyamide. In particular, a polyamide such as PA6 or PA12 is considered. Polypropylene is also considered as a material for the production of the aforementioned tank components.

The hydraulic tank with all discussed associated components may be produced completely from plastics material and may not contain any metal parts. However, it is not to be ruled out that metal sub-components, for example fixing elements which are part of one of the discussed holding formations, may be moulded into the plastics material in conjunction with specific components or functions.

The invention further provides an industrial truck which is formed with a hydraulic tank according to the invention associated with at least one hydraulic apparatus of the industrial truck. The hydraulic tank is fixed to a frame of the industrial truck, preferably by means of holding formations of the hydraulic tank. The hydraulic tank may have an adapted shape making it possible to achieve a space-saving assembly of the hydraulic tank, the hydraulic apparatus and further components of the industrial truck, for example one or more indentations for enabling the positioning of other components directly next to the tank with simultaneous efficient utilisation of the available installation space.

The invention further provides a method for producing a hydraulic tank which comprises:

- a tank lower part comprising a base and a side wall,
- a tank cover which is connected to an upper edge of the side wall and defines at least one hydraulic medium receiving chamber together with the base and the side wall,
- at least one hydraulic medium intake pipe extending from a hydraulic medium suction connector of the tank cover, preferably into a lower region of the hydraulic medium receiving chamber, and
- at least one hydraulic medium return pipe extending from a hydraulic medium return connector of the tank cover, preferably into a lower region of the hydraulic medium receiving chamber.

In accordance with the invention the method comprises the following production steps:

A) production in one piece of the tank lower part, preferably with use of an injection moulding procedure, B) production of a tank upper part which comprises the tank cover, the hydraulic medium intake pipe and the hydraulic medium return pipe and can be assembled as a modular unit with the tank lower part by
   - production in one piece of the tank cover or of a one-piece modular unit comprising this and at least one of the hydraulic medium intake pipe and the hydraulic medium return pipe, preferably with use of an injection moulding procedure, and

- if not produced in one piece with the tank cover:
     - supplementation of the tank cover or of the modular unit by the hydraulic medium intake pipe and/or the hydraulic medium return pipe to form a modular unit which comprises the tank cover, the hydraulic medium intake pipe and the hydraulic medium return pipe, and C) assembly of the tank upper part and of the tank lower part to form the hydraulic tank.

With this method, a hydraulic tank of the type mentioned at the outset for an industrial truck can advantageously be provided which is characterised in that the hydraulic medium intake pipe and the hydraulic medium return pipe form a tank upper part together with the tank cover, which tank upper part is assembled as a modular unit with the tank lower part to form the hydraulic tank.

Advantageous developments of the method will emerge from the above-proposed developments of the hydraulic tank according to the invention.

The invention will be described in greater detail hereinafter with reference to an embodiment illustrated in the figures, in which.

Figure 1:
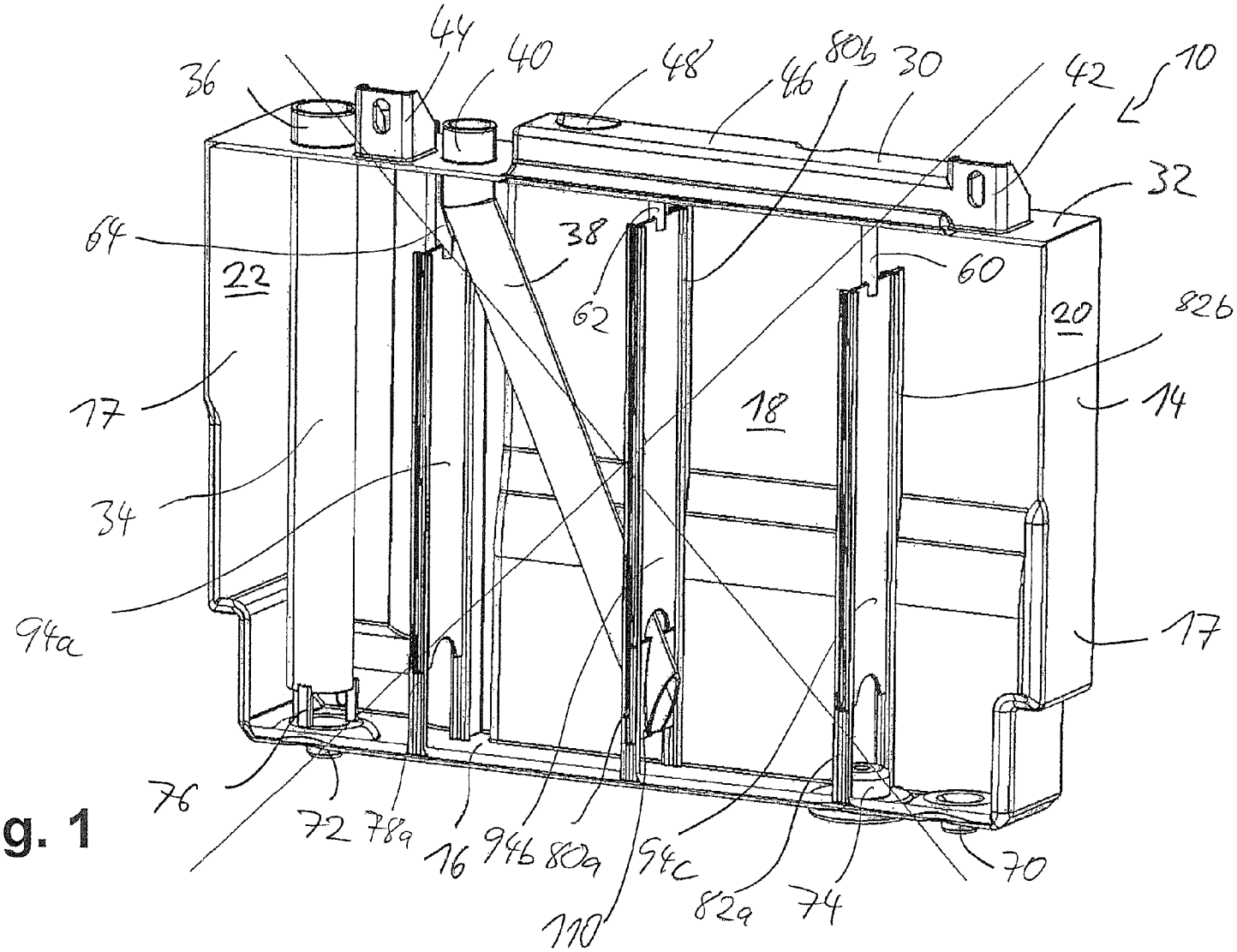
FIG. 1 is a "transparent" or cut-out view of a preferred embodiment of a hydraulic tank produced ready for installation.
Figure 6:
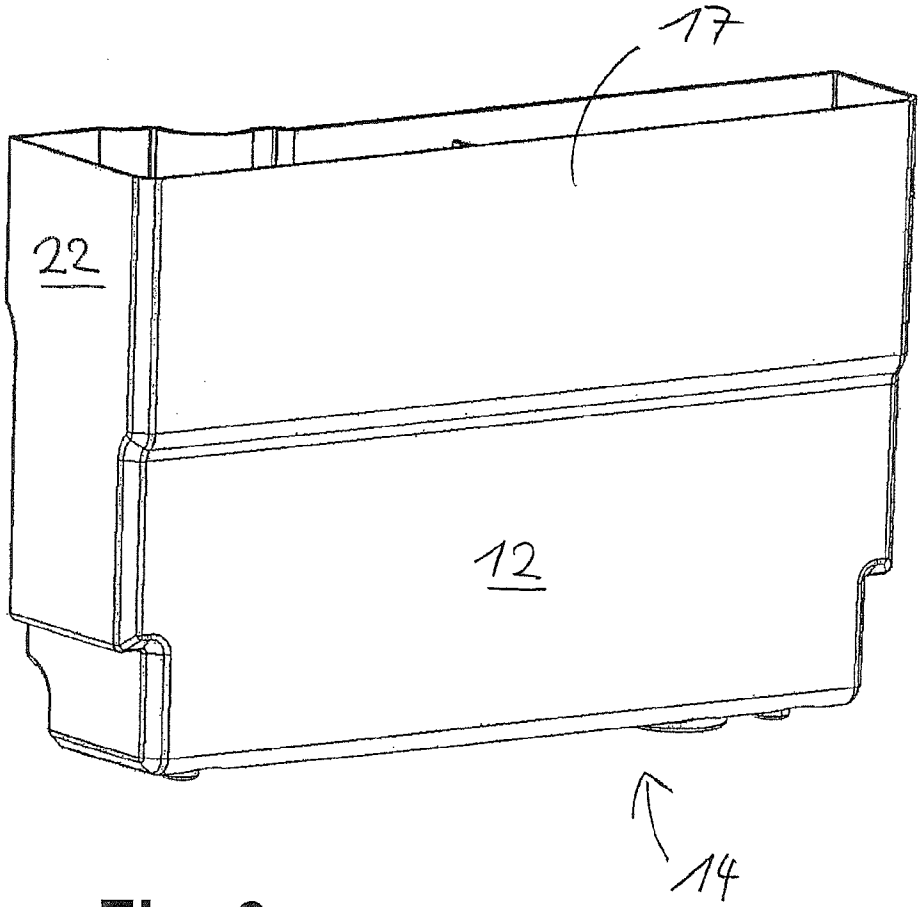
FIG. 6 is a further, other view of the tank lower part.

FIG. 1 shows a preferred embodiment of a hydraulic tank 10 according to the invention. The tank is shown in a transparent or sectional perspective view which basically corresponds to a cut-out view cut along the inner face of a rear tank wall 12 shown in FIG. 6 in plan view onto the outer face. In an upper region of the hydraulic tank, this cut corresponds to a cut in the plane characterised by a reticule in FIG. 1.

The hydraulic tank comprises a tank lower part 14 which comprises a tank base 16 and a side wall 17 formed by the above-discussed rear tank wall 12, an opposed front tank wall 18 and two side walls 20 and 22 which are mutually opposed in a transverse direction to the front-rear direction defined by the tank walls 12 and 18.

The tank lower part may advantageously be produced in one piece in an injection moulding procedure from a thermoplastic polymer material, for example polyamide, with use of an injection moulding die, of which the direction of demoulding corresponds to a vertical axis of the tank lower part.

Figure 2:
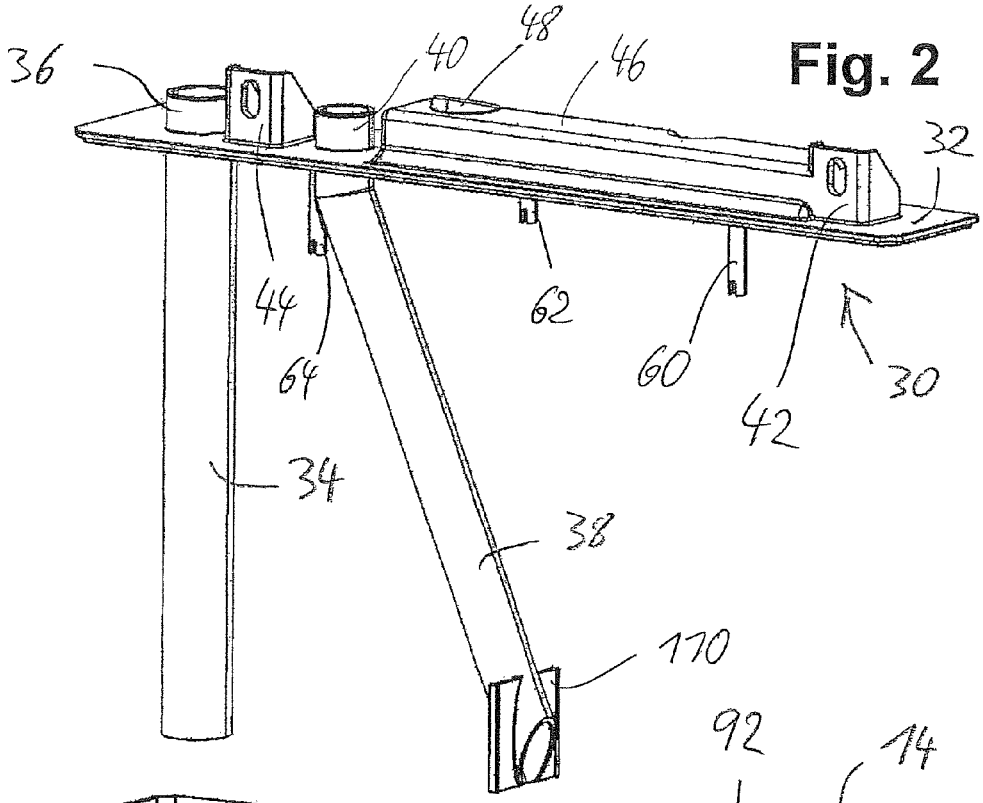
FIG. 2 shows a tank upper part which comprises a tank cover, a intake pipe and a return pipe and is manufactured so as to be assembled with an associated tank lower part to form the hydraulic tank according to FIG. 1.

A tank upper part 30 associated with the tank lower part 14 illustrated in FIGS. 3 to 6 and 8 is shown in FIG. 2. The tank upper part 30 comprises a cover 32 which, together with the side wall 17 and the tank base 16, defines a hydraulic medium receiving chamber of the hydraulic tank 10. When the tank is assembled according to FIG. 1, the tank upper part 30 is assembled with the tank lower part 14, preferably by welding, preferably laser welding. The contact face between the tank cover and the side wall may expediently be welded so that the laser only has to travel over a two-dimensional contour of the tank periphery, and does not have to be moved in a vertical direction.

In addition to the tank cover 32, the tank upper part 30 also comprises a hydraulic medium intake pipe 34 which protrudes via an upper end portion beyond an upper face of the tank cover 32 used as a hydraulic medium suction connector 36, via which a connected hydraulic apparatus can suck hydraulic medium (preferably hydraulic oil) from the hydraulic tank 10. The intake pipe 34 is preferably produced in one piece with the tank cover 32. This production may expediently take place by means of an injection moulding procedure, with use of a thermoplastic polymer material, for example polyamide. The direction of demoulding of the injection moulding die may expediently correspond to a vertical axis of the tank upper part 30, the intake pipe 34 corresponding to the direction thereof. In the assembled state shown in FIG. 1, the vertical axis of the tank upper part 30 may coincide with the vertical axis of the tank lower part 14.

Figure 10:
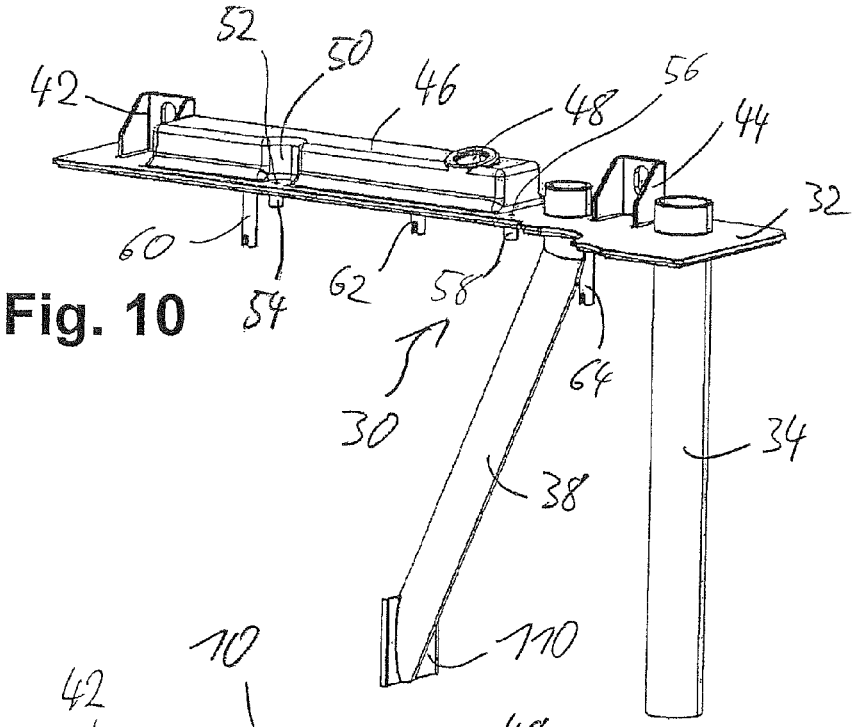
FIG. 10 is another view of the tank upper part of FIG. 2.

The tank upper part 30 further comprises a hydraulic medium return pipe 38 which extends, over regions, obliquely to the vertical axis and which protrudes via an upper end portion beyond an upper face of the tank cover 32 used as a hydraulic medium return connector 40. During hydraulic operation of the hydraulic apparatus, hydraulic medium to be fed back into the hydraulic tank 10 can be fed back into the hydraulic tank via this return connector. Depending on the intended production method, it is also considered to produce the return pipe 38 in one piece with the tank cover 32 or to produce the return pipe 38 separately and then join it to the tank cover 32. A separate production of the return pipe 38 from a preferably identical plastics material is preferred in conjunction with the production of the tank upper part in an injection moulding procedure. The return pipe 38 may then be inserted into an aperture in the tank cover 32 provided for this purpose and connected thereto in a rigid and hydraulic-medium-tight manner, for example by welding or adhesive bonding. The tank upper part 30 illustrated in FIGS. 2 and 10 is thus provided as a modular unit which can be assembled as a modular unit with the tank lower part 14.

The tank upper part 30, the tank cover 32 and the tank lower part 14 may expediently each be equipped with further functional elements produced in one piece therewith which result directly from a corresponding shaping of the mould used during the production process, in particular an injection mould.

The tank cover 32 thus comprises, on the cover upper face, holding formations or fixing elements 42 and 44 associated therewith which are used for secure fixing of the hydraulic tank in an industrial truck on the bodywork frame thereof. The tank cover 32 further comprises an elongate, square arrangement 46 in the transverse direction which is formed with an air filter connector 48 which may advantageously comprise an integrally moulded screw thread for the air filter.

To arrange and fix at least one further component, for example one or more hydraulic lines, the cover 32 further comprises, in the region of the box-like arrangement 46, an indentation 50 and a screw opening 52 which extends into a lug 54 on the cover lower face so as to provide a sufficient length to receive a fixing element which can be screwed in. Reference is made to FIG. 10. A further lug of this type and a screw opening on the upper face are denoted by 56 and 58.

Figure 7:
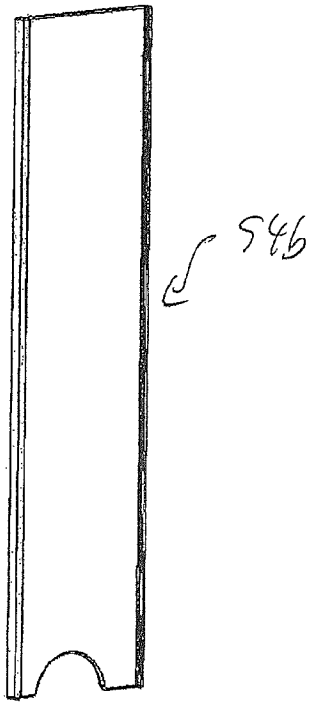
FIG. 7 shows one of a plurality of partition-wall-like intermediate elements which are arranged in the interior of the tank lower part and are used as a baffle and for reinforcement.
Figure 9:
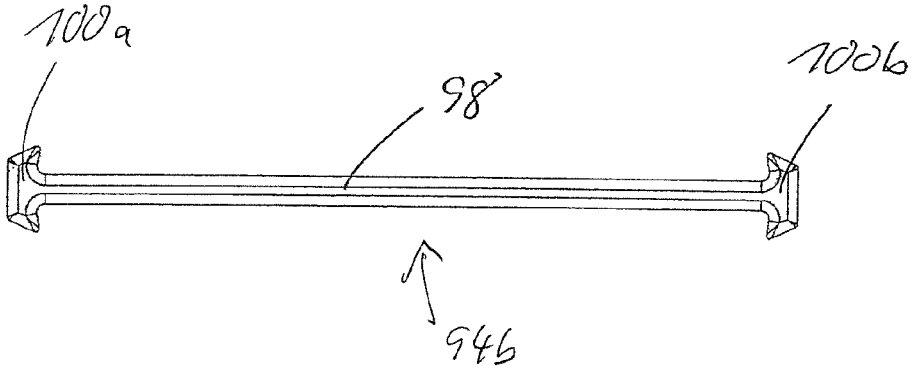
FIG. 9 is another view of the intermediate element of FIG. 7, viewed in a primary direction of extension.

The cover 32 further comprises on its lower face a plurality of supports 60, 62 and 64 which engage positively with intermediate elements separate from the tank lower part 14 and from the tank upper part 30, which intermediate elements provide tank reinforcement and are used as a baffle, and one of which is illustrated in FIGS. 7 and 9. According to FIG. 1, a plurality of such intermediate elements are arranged in the tank lower part 14.

All the functional elements discussed above are formed in one piece with the cover 32.

Figure 8:
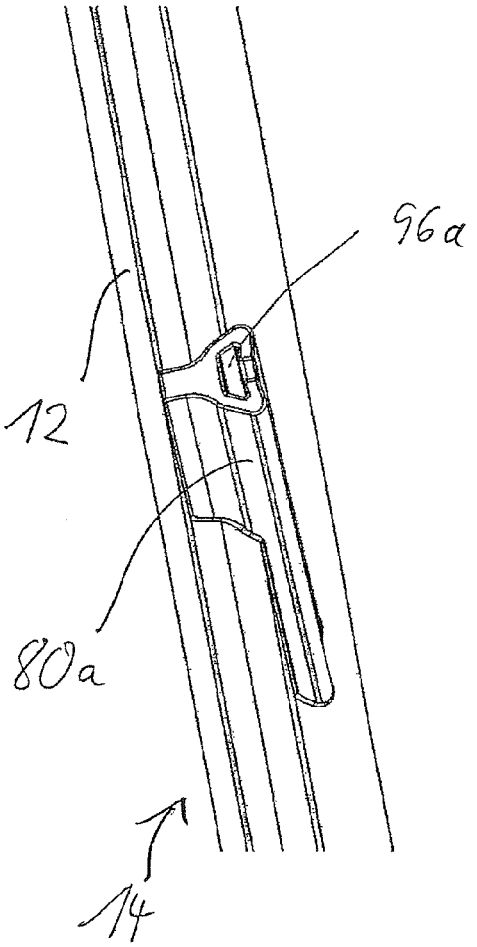
FIG. 8 shows a pair of web-like holding formations on the inner face of a front and of a rear edge portion of the tank lower part for positive holding of an intermediate element as shown in FIG. 7.
Figure 8:
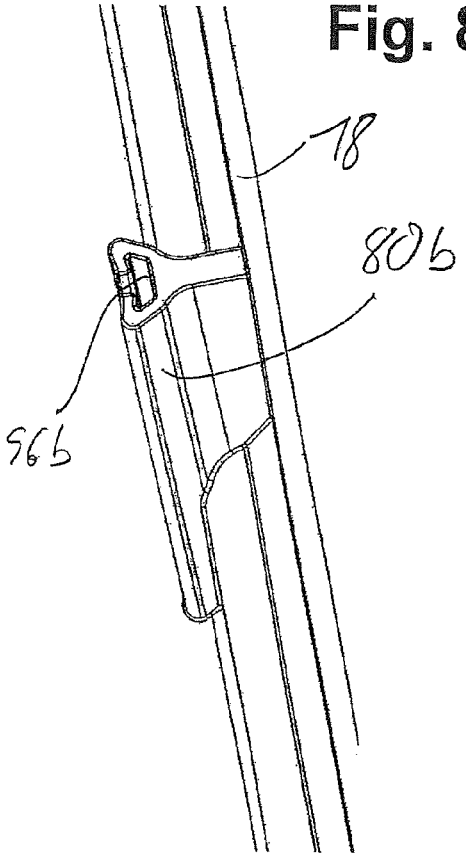

Accordingly, the tank lower part 14 also comprises arrangements and functional elements which are integrally moulded or formed in one piece therewith. Protruding holding formations 70 and 72 for mounting and fixing the tank in the industrial truck are thus formed on the tank base 16 on the outer face thereof (see FIG. 4). A drain assembly 74 is also formed in the tank base 16 and is used to drain the hydraulic medium (hydraulic oil) located in the receiving chamber of the tank and comprises an opening having a screw thread for a drain screw. A support assembly 76 is formed on the inner face of the base in the region of the holding formation 72 and engages positively with the lower end of the intake pipe 34 and secures the intake pipe 34 against vibrations produced during operation. On the inner face of the rear tank wall 12 and of the front tank wall 18, holding webs are also formed in one piece with the relevant tank wall and are used for positive holding of the intermediate elements discussed above and for production of a supporting connection, which can be loaded with tensile force and pressure, between the front and rear tank walls. These holding webs are denoted by 78*a*, 80*a* and 82*a* and by 78*b*, 80*b* and 82*b* in FIG. 5. All of these discussed embodiments of the tank lower part 14 are produced in one piece therewith. The holding webs extend in the direction of the vertical axis of the tank lower part. FIG. 8 shows an enlarged view, viewed in another direction, of a pair of associated holding webs, for example the webs 80*a* and 80*b*, on the front and rear tank walls.

Figure 3:
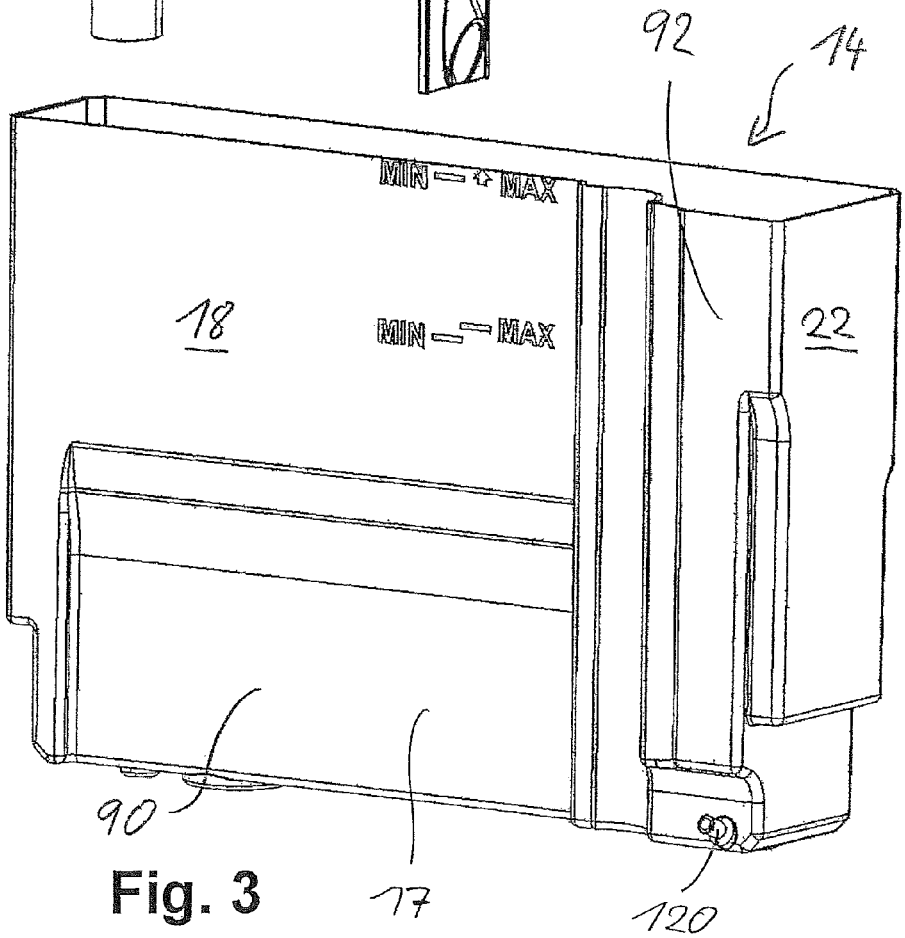
FIG. 3 shows the tank lower part which is associated with the tank upper part according to FIG. 2 and comprises a base and a side wall which define a receiving chamber together with the tank cover when assembled with the tank upper part.
Figure 4:
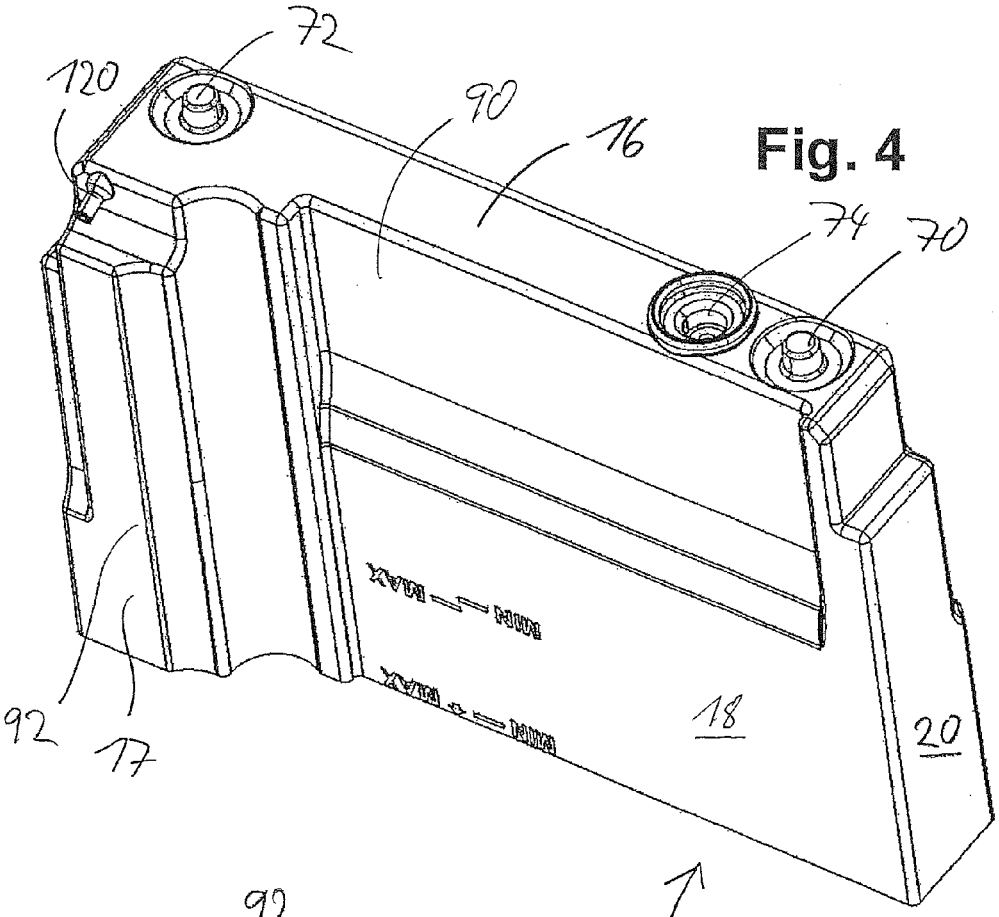
FIG. 4 is another illustration of the tank lower part of FIG. 3 with a view onto the tank base.
Figure 5:
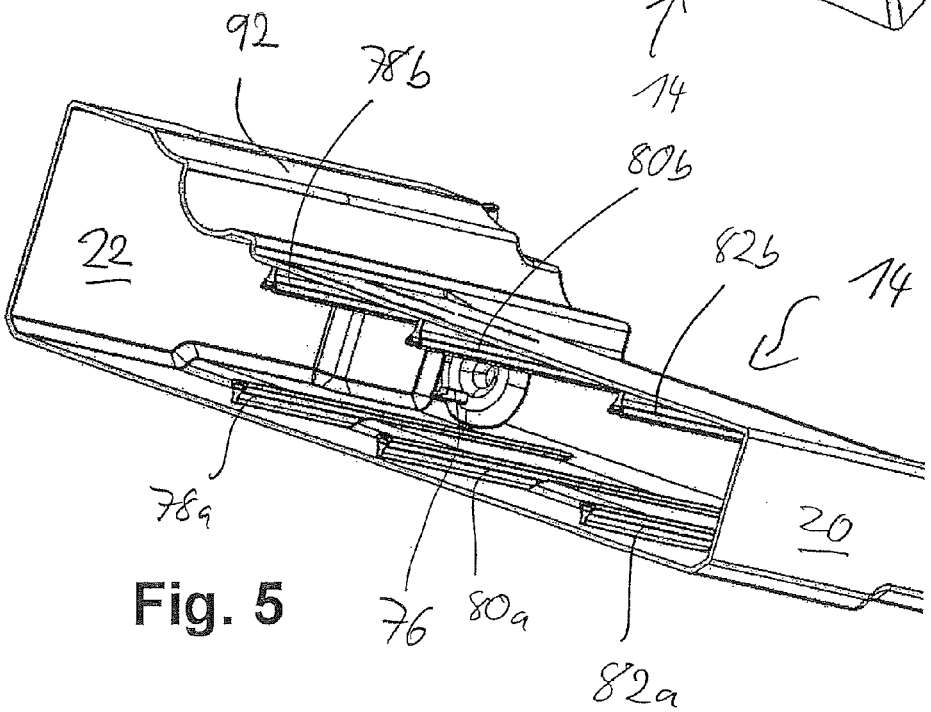
FIG. 5 is another illustration of the tank lower part with a view into the interior defined by the tank base and the side wall.
Figure 11:
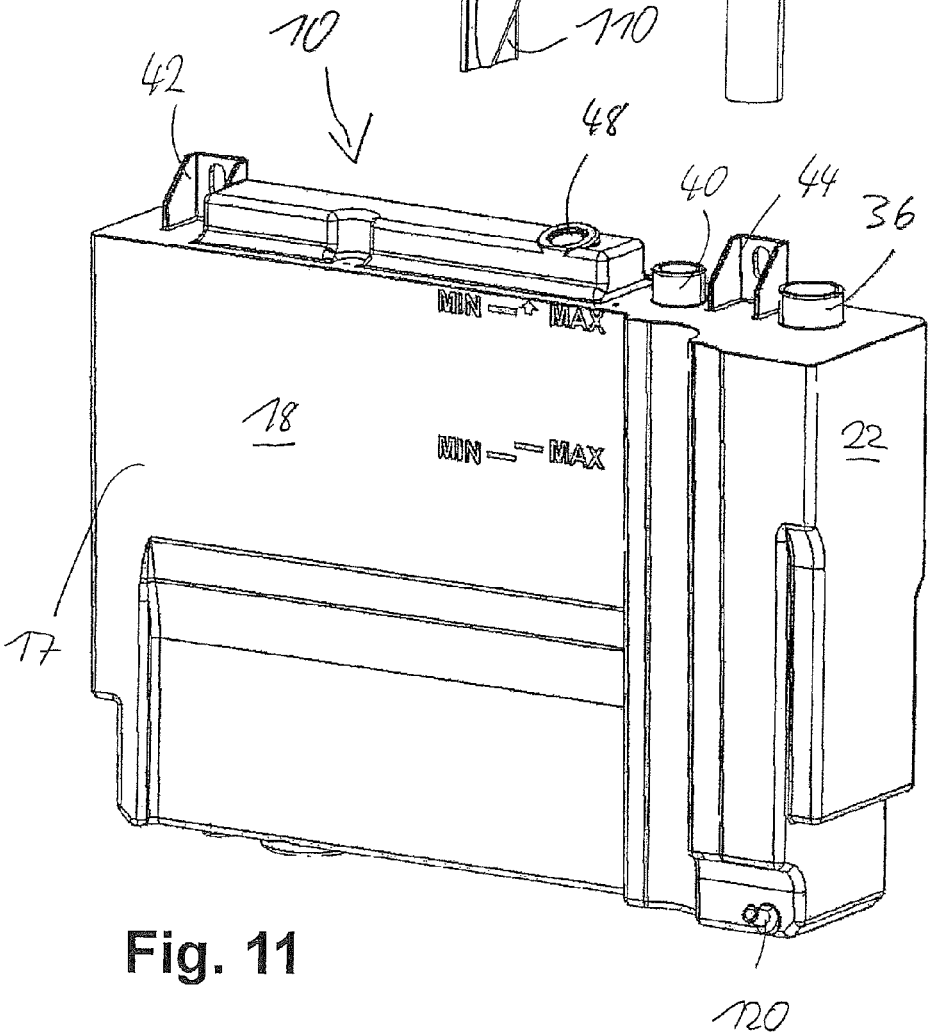
FIG. 11 is a side view of the finally produced hydraulic tank 10, viewed onto a front tank wall and a side wall.

Minimum and maximum markings for the fill level of the hydraulic medium in the tank may also expediently be moulded integrally in the outer face of the side wall of the tank, as can be seen in FIGS. 3, 4 and 11.

The hydraulic tank 10 and specifically also the lower part 14 thereof may advantageously be formed in such a way that a space-saving compact assembly of the hydraulic tank 10, including components to be arranged adjacent thereto such as a hydraulic apparatus and motor of the industrial truck, is enabled. The front tank wall 18 thus comprises an indentation 90 in a lower region, as well as a convexity 92 in a region adjacent to the side wall 22 over almost the entire height (see FIGS. 3, 4 and 5). The side walls 20 and 22 also extend in the vertical direction in a specific manner with regard to the assembly of the tank in the industrial truck (see FIGS. 1, 4 and 11).

According to FIG. 1, three intermediate elements 94*a*, 94*b* and 94*c* are received in the tank and are held in place positively by a respective holding web pair 78*a*, 78*b* or 80*a*, 80*b* or 82*a*, 82*b*. For this purpose, the webs comprise holding apertures or grooves 96*a* and 96*b* which extend in the vertical direction and which, opposite a wall-like portion 98 of the respective holding element, receive holding edges 100*a* and 100*b* of the respective holding element which protrude in the transverse direction and which are basically complementary to the aperture. Reference is made to FIGS. 7, 8 and 9. The intermediate element shown in FIGS. 7 and 9 may be the intermediate element 94*b*, which engages positively with the webs 80*a*, 80*b*.

As can be seen in FIG. 1, the tank interior is divided into sections by the intermediate elements, which sections communicate with one another however as a result of open passages beneath the respective intermediate element so that the hydraulic medium can flow from section to section. For example, the intermediate elements may comprise an aperture in a lower edge to ensure the passage of hydraulic medium, as can be seen in FIGS. 1 and 7. Alternatively or additionally, through-holes may be formed in the intermediate elements.

The intermediate elements are each inserted from above into the holding apertures in the respective holding web pair before assembly of the tank upper part with the tank lower part, preferably until they contact a stop formed by a lower end of the groove-like holding aperture. This stop may offset upwardly from the tank base 16 so as to ensure the necessary hydraulic flow between the tank sections. When assembling the tank upper part 30 to the tank lower part 14, the upper edges of the intermediate elements engage in a holding slit in a respective associated one of the supports 60, 62 and 64 on the cover lower face. For this purpose, the supports are each of an adapted length so that the relevant intermediate element is secured in an intended position contacting a stop and the cover is also supported by means of the intermediate element.

The described embodiment of the intermediate elements and of the holding webs is such that both tensile forces and compressive forces are transferred between the front and rear tank walls and a high level of stability is thus afforded to the tank.

As discussed, the intake pipe 34 is preferably secured against vibrations at the lower end, for example by the discussed support assembly 76 on the tank base. With regard to the return pipe 38 extending obliquely, it is also recommended to provide a device providing security against vibrations which holds the return pipe on a lower end region. FIGS. 1, 2 and 10 are based on a preferred embodiment in this regard.

The return pipe 38 is designed or provided at a lower end with an intermediate element 110 which, similarly to the intermediate elements 94*a*, 94*b* and 94*c*, is designed with holding edges, for example similar or identical to the holding edges 100*a* and 100*b*, which engage positively in associated holding apertures in holding webs on the inner faces of the front and rear tank walls. Holding webs separate from the holding webs 80*a* and 80*b* may be provided to hold in place the intermediate element 110, or said intermediate element 110 may also be held in place by means of the holding webs 80*a*, 80*b* for the intermediate element 94*b*. In the latter case, the intermediate element 94*b* does not contact a stop corresponding to an end of the holding aperture, but instead is to be positioned between the support 62 and the upper end of the intermediate element 110 at the lower pipe end of the return pipe 38 of the tank upper part 30 before assembly of the tank upper part 30 with the tank lower part 14, and is then to be inserted jointly with the intermediate element 110 into the holding aperture 96*a* and 96*b* via the holding edges when the tank upper part is assembled with the tank lower part. In contrast to the explanation provided above, only the intermediate elements 94*a* and 94*c* are to be positioned beforehand in the tank lower part 14 in this instance, whereas the intermediate element 94*b* is to be assembled with the tank lower part 14, together with the tank upper part 30.

As indicated in FIGS. 1, 2 and 10, the intermediate element 110 may comprise an opening, through which the lower end of the return pipe 38 extends. The intermediate element 110 is preferably adhesively bonded or welded to the return pipe 38. The intermediate element 110 may also reinforce the tank and act as a baffle together with the intermediate element 94*b*.

It is to be noted that, in contrast to the embodiment shown in the figures, the intermediate elements 94*a*, 94*b* and 94*c* may expediently be formed in one piece with the tank cover 32. In this case it is also possible to dispense with an additional pipe-holding intermediate element, such as the intermediate element 110, and to instead also use the intermediate element corresponding to the intermediate element 94*b* and formed in one piece with the tank cover 32 to perform the pipe-holding function.

In the embodiment in which they are formed in one piece with the tank cover 72, the intermediate elements could start from the lower face of the tank cover 32, wherein through-openings in the intermediate elements are preferably formed in an upper region however so as to allow air to flow from tank section to tank section.

As already discussed, a hydraulic apparatus drawing hydraulic medium from the hydraulic tank may also supply other hydraulic consumers and hydraulically operated functional elements of the industrial truck with pressurised hydraulic medium. The hydraulic tank may therefore comprise one or more additional return connectors which may be formed in the tank cover or in the tank lower part. FIGS. 3, 4 and 11 show such an additional return connector 120, which may be formed in one piece with the lower part 14 or may be inserted retrospectively into an opening, provided for this purpose, in the tank lower part 14 and preferably adhesively bonded or welded to the tank lower part. The return connector 120 may be used for example as a return of a steering system of the industrial truck.

Modifications and supplementations to the hydraulic tank according to the illustrated embodiment are readily possible, depending on the requirements and installation conditions in an industrial truck.

A hydraulic tank 10 for an industrial truck is provided, comprising:

- a tank lower part 14 comprising a base 16 and a side wall 17 and produced in one piece;
- a tank cover 32 which is connected to an upper edge of the side wall, is produced in one piece and defines at least one hydraulic medium receiving chamber together with the base 16 and the side wall 17;
- at least one hydraulic medium intake pipe 34 extending from a hydraulic medium suction connector 36 of the tank cover 32, preferably into a lower region of the hydraulic medium receiving chamber; and
- at least one hydraulic medium return pipe 38 extending from a hydraulic medium return connector 40 of the tank cover 32, preferably into a lower region of the hydraulic medium receiving chamber, which hydraulic tank is characterised in that the hydraulic medium intake pipe 34 and the hydraulic medium return pipe 38, together with the tank cover 32, form a tank upper part 30 which is assembled as a modular unit with the tank lower part 14 to form the hydraulic tank 10.

A method for producing such a hydraulic tank is also provided.

The invention claimed is:

1. A hydraulic tank for an industrial truck, comprising:

- a tank lower part comprising a base and a side wall and produced in one piece;
- a tank cover connected to an upper edge of the side wall, wherein the tank cover is produced in one piece and defines at least one hydraulic medium receiving chamber together with the base and the side wall;
- at least one hydraulic medium intake pipe extending from a hydraulic medium suction connector of the tank cover; and
- at least one hydraulic medium return pipe extending from a hydraulic medium return connector of the tank cover,
- wherein the hydraulic medium intake pipe, the hydraulic medium return pipe, and the tank cover form a tank upper part that is assembled as a modular unit with the tank lower part to form the hydraulic tank, and
- wherein the tank lower part is formed with at least one of:
  - at least one holding formation on an outer face of the wall and/or on an outer face of the base for holding the tank in the industrial truck;
  - at least one hydraulic medium outlet;
  - at least one holding formation on an inner face of the base for holding a lower end portion of an associated one of the hydraulic medium intake pipe and the hydraulic medium return pipe;
  - at least one further hydraulic medium return connector;
  - at least one minimum marking and at least one maximum marking on an outer face of the for identifying at least one intended minimum and at least one intended maximum fill level of the hydraulic medium in the hydraulic medium receiving chamber; and at least one holding formation on an outer face of the wall for holding a hydraulic line or another component associated or to be associated spatially with the hydraulic tank.

2. The hydraulic tank according to claim 1, wherein at least one of the hydraulic medium intake pipe and the hydraulic medium return pipe is produced in one piece with the tank cover.

3. The hydraulic tank according to claim 2, wherein the at least one of the hydraulic medium intake pipe and the hydraulic medium return pipe is produced as one piece with the tank cover in an injection moulding procedure.

4. The hydraulic tank according to claim 1, wherein at least one of the hydraulic medium intake pipe and the hydraulic medium return pipe extends obliquely to a vertical axis of the hydraulic tank.

5. The hydraulic tank according to claim 1, wherein at least one of the hydraulic medium intake pipe and the hydraulic medium return pipe is welded or adhesively bonded to the cover.

6. The hydraulic tank according to claim 3, wherein the at least one of the hydraulic medium intake pipe and the hydraulic medium return pipe that is welded or adhesively bonded to the cover extends obliquely to the vertical axis.

7. The hydraulic tank according to claim 1, wherein the cover is formed with at least one of:

at least one holding formation, on a cover outer face for holding the tank in the industrial truck;

at least one air filter connector;

at least one engagement formation on a cover inner face for engagement with an intermediate element that is provided for tank reinforcement and/or as a baffle in the hydraulic medium receiving chamber and extends between a front and a rear wall portion of the wall;

at least one intermediate element on a cover inner face, that extends between a front and a rear wall portion of the wall, and is provided in the hydraulic tank receiving chamber for tank reinforcement and/or as a baffle; and at least one holding formation, on a cover outer face for holding a hydraulic line or another component associated or to be associated spatially with the hydraulic tank.

8. The hydraulic tank according to claim 7, wherein the at least one holding formation for holding the tank in the industrial truck is produced in one piece with the cover.

9. The hydraulic tank according to claim 7, wherein the at least one air filter connector is produced in one piece with the cover.

10. The hydraulic tank according to claim 7, wherein at least one air filter connector comprises a screw thread for screwing to an air filter.

11. The hydraulic tank according to claim 1, wherein a front and a rear wall portion are connected by at least one intermediate element extending therebetween the intermediate element being used as a baffle and/or as tank reinforcement.

12. The hydraulic tank according to claim 11, wherein the intermediate element is produced in one piece, with the side wall or is engaged positively on the front and rear wall portions in each case with a holding formation of the respective front and rear wall portions produced in one piece with the side wall.

13. The hydraulic tank according to claim 11, wherein both tensile forces and compressive forces are transferable between the front and the rear wall portions by means of the intermediate element or by means of the intermediate element being positively engaged with the holding formations.

14. The hydraulic tank according to claim 13, wherein the holding formations of the front and the rear wall portions are formed as holding webs on the inner face of the wall that extend in the direction of a vertical axis of the hydraulic tank, and wherein each holding web comprises a holding aperture that extends in the direction of the vertical axis and extends in the transverse direction starting from a slit so as to positively engage a holding edge.

15. The hydraulic tank according to claim 1, wherein at least one of the pipe of the hydraulic medium intake pipe and the hydraulic medium return pipe extends obliquely relative to the vertical axis of the hydraulic tank and is held at a lower end portion by an intermediate element connecting the front and the rear wall portions.

16. The hydraulic tank according to claim 1, wherein at least the tank cover and the tank lower part of the hydraulic tank are produced from a thermoplastic polymer material.

17. An industrial truck comprising:

a hydraulic tank that is associated with at least one hydraulic apparatus of the industrial truck and is fixed to a frame of the industrial truck, wherein the hydraulic tank includes:

a tank lower part comprising a base and a side wall and produced in one piece;

a tank cover connected to an upper of the side wall, wherein the tank cover is produced in one piece and defines at least one hydraulic medium receiving chamber together with the base and the side wall;

at least one hydraulic medium intake pipe extending from a hydraulic medium suction connector of the tank cover; and at least one hydraulic medium return pipe extending from a hydraulic medium return connector of the tank cover, wherein the hydraulic medium intake pipe, the hydraulic medium return pipe, and the tank cover form a tank upper part that is assembled as a modular unit with the tank lower part to form the hydraulic tank, and wherein the tank lower art is formed with at least one of:

at least one holding formation on an outer face of the wall and/or on an outer face of the base for holding the tank in the industrial truck;

at least one hydraulic medium outlet;

at least one holding formation on an inner face of the base for holding a lower end portion of an associated one of the hydraulic medium intake pipe and the hydraulic medium return pipe;

at least one further hydraulic medium return connector;

at least one minimum marketing and at least one maximum marking on an outer face of the wall for identifying in at least one intended minimum and at least one intended maximum fill level of the hydraulic medium in the hydraulic medium receiving chamber; and at least one holding formation on an outer face of the wall for holding a hydraulic line or another component associated or to be associated spatially with the hydraulic tank.

18. A method for producing a hydraulic tank comprising: a tank lower part comprising a base and a side wall, a tank cover connected to an upper edge of the side wall and defining at least one hydraulic medium receiving chamber together with the base and the side wall; at least one hydraulic medium intake pipe extending from a hydraulic medium suction connector of the tank cover; and at least one hydraulic medium return pipe extending from a hydraulic medium return connector of the tank cover, the method comprising:

producing the tank lower part in one piece; and producing the tank upper part, the tank upper part comprising the tank cover, the hydraulic medium intake pipe, and the hydraulic medium return pipe, the tank upper part being assembled as a modular unit with the tank lower part by:

producing the tank cover in one piece or producing the tank cover as part of a one-piece modular unit comprising the tank cover and at least one of the hydraulic medium intake pipe and the hydraulic medium return pipe; and connecting the tank cover or the modular unit with the hydraulic medium intake pipe and/or the hydraulic medium return pipe to form a modular unit that comprises the tank cover, the hydraulic medium intake pipe and/or the hydraulic medium return pipe; and attaching the tank upper part to the tank lower part to form the hydraulic tank, wherein the tank lower part is formed with at least one of:

at least one holding formation on an outer face of the wall and/or on an outer face of the base for holding the tank in the industrial truck;

at least one hydraulic medium outlet;

at least one holding formation on an inner face of the base for holding a lower end portion of an associated one of the hydraulic medium intake pipe and the hydraulic medium return pipe;

at least one further medium return connector;

at least one minimum marking and at least one maximum marking on an outer face of the for in at least one intended minimum and at least one intended maximum fill level of the hydraulic medium in the hydraulic medium receiving chamber; and at least one holding formation on an outer face of the wall for holding a hydraulic line or another component associated or to be associated spatially with the hydraulic tank.

19. The method of claim 18, wherein at least one of the hydraulic medium intake pipe and the hydraulic medium return pipe is produced in one piece with the tank cover.

* * * * *